US005400430A

United States Patent [19]

Nenniger

[11] Patent Number: 5,400,430

[45] Date of Patent: * Mar. 21, 1995

[54] METHOD FOR INJECTION WELL STIMULATION

[76] Inventor: John E. Nenniger, 4512 Charleswood Dr. NW., Calgary, Canada, T2L2E5

[ * ] Notice: The portion of the term of this patent subsequent to Jan. 25, 2011 has been disclaimed.

[21] Appl. No.: 183,704

[22] Filed: Jan. 21, 1994

Related U.S. Application Data

[63] Continuation-in-part of Ser. No. 767,704, Sep. 30, 1991, Pat. No. 5,282,263, which is a continuation-in-part of Ser. No. 590,755, Oct. 1, 1990, Pat. No. 5,120,935.

[51] Int. Cl.[6] ..... E21B 7/15; H05B 3/02

[52] U.S. Cl. ..... 392/305; 392/301; 166/302; 166/60; 166/304

[58] Field of Search ..... 392/301, 304, 305, 303, 392/485; 166/303, 60, 302, 57, 304, 307, 311, 312, 65.1, 64, 53; 338/52, 54; 219/544, 553

[56] References Cited

U.S. PATENT DOCUMENTS

| | | | |
|---|---|---|---|
| 47,410 | 4/1865 | Fraser | 166/302 |
| 231,287 | 8/1880 | Digman et al. | 392/301 |
| 457,457 | 8/1891 | Robison et al. | 392/305 |
| 522,737 | 7/1894 | Lucock | 219/630 |
| 573,142 | 12/1896 | Flanegin | 166/303 |
| 762,628 | 6/1904 | Gardner | 392/306 |
| 766,313 | 8/1904 | Yoast | 392/305 |
| 780,279 | 1/1905 | Gardner | 166/60 |
| 784,454 | 3/1905 | Waring | 392/305 |
| 884,424 | 4/1908 | Seymour et al. | 166/60 |
| 972,308 | 10/1910 | Williamson | 392/304 |
| 1,082,971 | 12/1913 | Pick | 392/303 |
| 1,095,365 | 5/1914 | Williamson | 392/305 |
| 1,169,262 | 1/1916 | Huff | 392/304 |
| 1,232,736 | 7/1917 | Truman et al. | 392/305 |
| 1,360,404 | 11/1920 | Hollister et al. | 392/305 |
| 1,368,404 | 2/1921 | Loftus | 392/305 |
| 1,383,670 | 7/1921 | Stephens | 392/301 |
| 1,426,407 | 8/1922 | Pennington | 392/304 |
| 1,450,658 | 4/1923 | Warnick | 392/301 |
| 1,457,690 | 6/1923 | Brine | 392/305 |
| 1,464,618 | 8/1923 | Pershing | 392/305 |
| 1,477,802 | 12/1923 | Beck | 392/305 |
| 1,504,208 | 8/1924 | Brine | 392/305 |
| 1,540,648 | 6/1925 | Pershing | 392/305 |
| 1,646,599 | 10/1927 | Schaefer | 392/304 |
| 1,672,200 | 6/1928 | Buck | 166/60 |
| 1,690,994 | 11/1928 | Powell | 392/301 |

(List continued on next page.)

FOREIGN PATENT DOCUMENTS

| | | |
|---|---|---|
| 1182392 | 2/1985 | Canada . |
| 2504187 | 10/1982 | France . |
| 1298354 | 3/1987 | U.S.S.R. . |
| 8810356 | 12/1988 | WIPO . |

OTHER PUBLICATIONS

Nenninger et al, "Optimizing Hot Oiling/Watering Jobs to Minimize Formation Damage", Petro. Society of CIM/Soc. of Petro Eng, 1990.

(List continued on next page.)

*Primary Examiner*—Bruce A. Reynolds
*Assistant Examiner*—John A. Jeffery
*Attorney, Agent, or Firm*—Bereskin & Parr

[57] ABSTRACT

A method of stimulating injection wells having a wellbore. The method includes the steps of placing a heater at or near the bottom of the well, adjacent to the area to be treated, energizing the heater to release heat energy, flowing a solvent past the heater to the area to be treated to contact solid wax deposits to mobilize the wax deposits, removing the mobilized wax and the solvent from the well area, and injecting waterflood water into the well and into the passageways that were previously blocked by the wax deposits. In one embodiment there is a further pretreatment step of selecting an appropriate thief zone blocker fluid and injecting the same into the well to selectively obstruct the thief zones. In a further embodiment there is a further pretreatment step of choosing an appropriate oil zone blocking fluid and injecting the same into the well prior to the injection of the thief zone blocking fluid to protect the same.

32 Claims, 4 Drawing Sheets

U.S. PATENT DOCUMENTS

| | | | |
|---|---|---|---|
| 1,701,884 | 2/1929 | Hogle | 392/301 |
| 1,761,227 | 6/1930 | Pasley | 392/304 |
| 1,776,997 | 9/1930 | Downey | 392/305 |
| 1,839,632 | 1/1932 | Agnew | 392/305 |
| 2,202,034 | 5/1940 | Thomas | 392/301 |
| 2,208,087 | 7/1940 | Somers | 392/301 |
| 2,244,256 | 6/1941 | Looman | 392/301 |
| 2,260,916 | 10/1941 | Rial | 392/305 |
| 2,332,708 | 10/1943 | Freeman | 392/303 |
| 2,484,063 | 10/1949 | Ackley | 392/304 |
| 2,500,305 | 3/1950 | Ackley | 392/304 |
| 2,632,836 | 3/1953 | Ackley | 392/304 |
| 2,660,249 | 11/1953 | Jakosky | 392/304 |
| 2,666,487 | 1/1954 | Bowman | 392/301 |
| 2,685,930 | 8/1954 | Albaugh | 166/302 |
| 2,808,110 | 10/1957 | Spitz | 392/304 |
| 2,836,248 | 5/1958 | Covington | 392/302 |
| 2,998,066 | 8/1961 | Nixon, Sr. | 166/304 |
| 3,163,745 | 12/1964 | Boston | 392/305 |
| 3,279,541 | 10/1966 | Knox et al. | 166/304 |
| 3,410,347 | 11/1968 | Triplett et al. | 166/302 |
| 3,437,146 | 4/1969 | Everhart et al. | 166/304 |
| 3,614,986 | 10/1971 | Gill | 166/303 |
| 3,828,161 | 8/1974 | Yamaguchi | 392/485 |
| 3,943,330 | 3/1976 | Pollock et al. | 219/553 |
| 4,026,358 | 5/1977 | Allen | 166/271 |
| 4,178,993 | 12/1979 | Richardson et al. | 166/312 |
| 4,219,083 | 8/1980 | Richardson et al. | 166/312 |
| 4,285,401 | 8/1981 | Erickson | 166/60 |
| 4,330,037 | 5/1982 | Richardson et al. | 166/303 |
| 4,399,868 | 8/1983 | Richardson et al. | 166/304 |
| 4,790,375 | 12/1988 | Bridges et al. | 166/304 |
| 4,911,239 | 3/1990 | Winckler et al. | 166/304 |
| 5,120,935 | 6/1992 | Nenninger | 392/305 |
| 5,247,994 | 9/1993 | Nenninger | 392/305 |
| 5,282,263 | 1/1994 | Nenninger | 392/305 |

OTHER PUBLICATIONS

Nelson et al, "Oil Recovery By Thermal Methods", Pt. 1, *The Petroleum Engineer,* Feb., 1959.

"High Temperature Thermal Techniques for Stimulating Oil Recovery", P. D. White et al, J. of Petro. Technology, pp. 1007–1011, Sep., 1965.

C. C. Nathan, "Solubility Studies on High Molecular Weight Paraffin Hydrocarbons Obtained from Petroleum Rod Waxes", Petr. Trans. AIME, v. 204, pp. 151–155, 1955.

R. Van A. Mills The Paraffin Problem in Oil Wells Dec. 1923.

John Power Removing Paraffin Deposits from Wells with Electric Heater 1928.

L. G. E. Bignell Electric Heaters Remove Paraffin Nov. 14, 1929.

C. E. Reistle, Jr. and O. C. Glade Paraffin and Congealing–Oil Problems 1932.

Frank V. Eaton Applications of Heat Increases Production in Wyoming Field Apr. 22, 1943.

F. R. Cozzens "Sand Face Cleaning with Lye, Aluminum and Oil" Aug. 1948.

H. E. Allen and R. K. Davis "Electric Formation Heaters and Their Application" Apr. 1954.

K. G. Parrent "Bottom Hole Heaters" May 1955.

World Oil "AC Current Heats Heavy Oil for Extra Recovery" May 1970.

Dr. S. M. Faroug Ali "Well Stimulation by Downhole Thermal Methods" Oct. 1973.

D. L. Currans "Electroflood Proves Technically Feasible" Jan. 1980.

David R. Davies, Edwin A. Richardson and Dan Antheunis "Field Applications of In–Situ Nitrogen Gas Generation System" Mar. 1981.

Products and Methods Bulletin Chemical Unit "Field Application of a Chemical Heat and Nitrogen Generating System" Mar. 1984.

H. W. McSpadden, M. L. Tyler and T. T. Velasco "In–Situ Heat and Paraffin Inhibitor Combination Prove Cost Effective in NPR #3", Cooper, Wyoming Apr. 1986.

J. P. Ashton, L. J. Kirspel, H. T. Nguyen & D. L. Credeur "In–Situ Heat System Stimulates Paraffinic Crude Producers in Gulf of Mexico" Oct. 1986.

Edward T. Yukl & Andrew W. Marr, Jr. "Process Solves Paraffin Buildup in Tubing" Aug. 8, 1988.

Petrotherm Electric Bottom–Hole Heating System.

METHOD FOR INJECTION WELL STIMULATION

This is a continuation in part of Ser. No. 07/767,704, filed Sep. 30, 1991, now U.S. Pat. No. 5,282,263, which is a continuation in part of Ser. No. 07/590,755, filed Oct. 1, 1990, now U.S. Pat. No. 5,120,935.

FIELD OF THE INVENTION

This invention relates generally to the field of extraction of hydrocarbons, such as oil, gas and condensates, from underground reservoirs. More particularly, this invention relates to the stimulation and enhancement of production or recovery of such hydrocarbons from such reservoirs.

BACKGROUND OF THE INVENTION

Much of our current energy needs are met through use of hydrocarbons, such as oil, natural gas, and condensates, which are recovered from naturally occurring deposits or reservoirs. Liquid hydrocarbons are often produced by pumping them from the reservoir to storage tanks or a flow line connected to the wellhead. The pumping or "lifting" costs include capital costs, such as the pump, the prime mover (i.e., motor), the rods and the tubing, oil/water/gas separation facilities, and operating costs, such as labour, royalties, taxes, and electricity. Because some of these costs are fixed, a certain production rate is required to make such recovery economically feasible. If the revenue generated by selling the recovered hydrocarbons is less than the lifting costs to so recover them, then the well may be temporarily closed up or permanently shut in. In some cases wells may be reopened when new technology becomes available, and in other cases the well may be reopened if energy prices rise, once again making production and recovery economically attractive. Alternatively, a permanently shut-in well would be plugged with concrete and abandoned altogether.

Typically, an oil well will be shut in or abandoned when less than a third of .the original oil in place in the reservoir is recovered, because it becomes uneconomic to continue to operate the well. Thus, about two thirds of the original oil is abandoned because it cannot be economically recovered. This unrecovered oil has been recognized as a lost resource in the past and thus there have been many techniques proposed to stimulate production rates and consequently increase the ultimate recovery of oil from reservoirs.

There are a number of reasons why oil and gas well productivity may decline over time. For example, productivity declines if 1) there is insufficient pressure differential between the well and the reservoir, 2) the flow between the reservoir and the well is obstructed, or 3) the mobility of the oil is restricted due to relative permeability effects. Conventional production practice, such as waterflooding, gas re-injection and the like, is generally effective for maintaining reservoir pressure to overcome the first problem. It is normal oilfield practice to waterflood reservoirs by re-injecting the produced water along with makeup (i.e. source) water back into the reservoir.

The produced water is cleaned up prior to re-injection in order to avoid reinjection of oil back into the reservoir. Typically the residual oil concentration in the injection water, is specified to be less than 50 to 100 parts per million. However, the separation of oil from the water can experience a number of problems. For example, as a waterflood matures, the total water production increases, so larger volumes of water must be cleaned for reinjection. The separation efficiency of the treating facilities may also decrease due to the increased throughput and shorter time available for separation. The separation facilities may also experience process upsets which allow the injection water to be contaminated with oil. The net effect is that some oil is inadvertently re-injected back into the reservoir in the injection water.

The oil re-injection represents a small loss of revenue in most cases and is generally not of great concern. However, the water is usually re-injected at a temperature considerably below the reservoir temperature. At the re-injection temperature there may be considerable waxy solids present in the oil carryover. When these waxy solids are re-injected into the formation, they are very efficient at plugging the near wellbore area in the injection well. The consequences are reduced injectivity, poor pressure maintenance in the reservoir and ultimately reduced oil recovery from the reservoir.

Another problem arises if the reservoir contains several layers (zones) which are being produced simultaneously. In this case, the waxy solids will tend to preferentially plug the less permeable layers. This selective plugging occurs because the less permeable layers are more effective at filtering out the waxy solids and thereby retaining the waxy solids in the near wellbore area where they restrict inflow. The net effect is that the injection water is preferentially channelled through the most highly permeable zones (so called "thief" zones) with consequent premature waterflood breakthrough and poor sweep efficiency. Often the heterogeneous nature of a reservoir (i.e. presence of multiple layers) is difficult to recognize so a problem may not be easily diagnosed.

Several methods have been developed by the industry to stimulate injection wells to improve pressure maintenance, sweep efficiency and consequently increase profitability and extend the ultimate recovery. One common method is acidization, in which an acid is pumped into a reservoir to dissolve formation rock and precipitated scales to stimulate injection rates in wells. However, matrix acidization is not effective for wells which have solid wax damage, because the solid wax is insoluble in acid. Because acidization is inherently prone to create channels along the path of "least resistance", the acid often bypasses the low permeability wax damaged oil zone and instead penetrates directly into the high permeability undamaged zone. Thus, the acid stimulation of the injection wells tends to improve the injectivity of the high conductivity zone which contributes to premature waterflood breakthrough and poor sweep efficiency. Thus, wax deposits can limit the success of acidization stimulation, even preventing effective removal of any dissolvable rock or precipitation which are wax coated.

Another technique is referred to as hydraulic fracture. In this technique, a high pressure fluid is used to fracture the rock formation, thus creating a channel which penetrates into the reservoir. The fracture is subsequently propped open using a granular material, such as sand. The fracture bypasses hydraulic restrictions to the inflow of water into the well by creating a new open channel and also by exposing a large surface area of the reservoir rock to the channel, thereby greatly increasing injectivity of the formation surrounding the bottom of the well. However, this technique can also create channels which extend toward the production wells and consequently bypass existing oil reserves. For this reason hydraulic fracturing of injection wells is generally considered undesirable and considerable efforts are made to avoid the possibility of fracturing. If the injectivity is so low that fractures are deemed necessary, then efforts are made to keep the fractures as small as possible.

Other treatments to stimulate injection wells include perforating the casing of the well with shaped charges to provide channels or perforation tunnels through which the fluids can flow. Again this technique is fairly expensive and it can be difficult to decide exactly where the wax damaged zones are and to hit them accurately. Moreover perforating only provides a short term improvement and does not remove accumulations of wax, nor, prevent the further accumulation of wax.

Another technique for stimulating injection rates is thermal stimulation. In the case of thermal stimulation, oil, water or steam heated above grade may be pumped to the bottom of the well to try to remove wax from the recovery area. However, it has been found very difficult to transfer the heat by steam, water or oil to the bottom of the well by reason of the thermal losses which take place as the hot medium is being transported down the well bore. (Society of Petroleum Engineers, Paper No. CIM/SPE 90-57 OPTIMIZING HOT OILING/WATERING JOBS TO MINIMIZE FORMATION DAMAGE by John Nenniger and Gina Nenniger of Nenniger Engineering Inc.) Heat from the "hot oil" is lost through the casing to the rock surrounding the well. Temperature measurements at the bottom of the well show that the bottom hole temperature drops during the treatment and excessive volumes of hot fluid do not significantly raise the bottom hole temperature. Typically, the heated fluid will lose its excess temperature in the top 300–400 m section of the well due to heat losses. By the time the "hot fluid" reaches the production zone at bottom of the well, it is likely cooler than the casing and thus actually absorbs heat from the casing and the rock surrounding the well. Thus for most applications, the "hot fluid" arrives at the bottom of the well at a temperature below the reservoir temperature. Because the bottom hole temperature decreases during treatment, waxy solids are likely to precipitate from the crude oil and be filtered out in the pores of the reservoir in the recovery zone as the fluid flows into the recovery zone. Thus, although the "hot oil" technique removes the wax deposits near the wellhead, it often causes an accumulation of the waxy solids in the perforation tunnels and reservoir surrounding the well. Thus, the application of heat to the well by pumping "hot oil" into the well is inadequate to remove waxy deposits in the formation and in fact usually leads to even greater formation damage.

Another method of thermal stimulation is disclosed in Canadian Patent 1,182,392, dated Feb. 12, 1985 in the name of Richardson et al. (see also U.S. Pat. No. 4,219,083) which discloses a nitrogen gas generation system to produce a heat spike in a water-based brine solution. In this method, the salt water solution undergoes a chemical reaction to release heat, together with nitrogen gas, as it is being delivered down the well, thereby avoiding some of the heat losses associated with transporting a hot fluid down the well as discussed above for the "hot oil" technique; the salt water solution only becomes hot when it is some way down the well. The salt water solution may then be shut in for a period of about 24 hours to allow the heat carried by the solution to melt wax located in the recovery zone. The disclosure notes that wax solvents may be flushed down the well prior to or after the injection of the heat-producing salt water solution.

However, there are several inherent disadvantages to the method disclosed in U.S. Pat. No. 1,182,392. Firstly, the wax is not soluble in the salt water solution, so even if the heat developed is sufficient to melt the solid wax deposits, two separate liquid phases will occur (i.e. a liquid hydrocarbon phase including liquid wax and crude oil and a liquid aqueous phase including formation water and salt water solution). If the water saturation is high in order to get a significant temperature rise then the relative permeability of the liquid hydrocarbon phase will be very low as compared to the water and the mobility of the hydrocarbon phase containing the wax will be obstructed. Thus, the water-based fluid cannot effectively carry the melted wax back into the reservoir and thereby remove the hydraulic blockage in the near wellbore area.

SUMMARY OF THE INVENTION

What is desired therefore, is a method to increase the usefulness of injection wells. If the reservoir is heterogeneous, namely the reservoir contains two or more zones then it is desired to have a method which can selectively restrict (i.e. damage) water injection into the high permeability thief zones and selectively increasing the injectivity of the target oil zones. If the reservoir is homogeneous, then it is desired to have a method which can increase the injectivity, of the injection well. Preferably, such a method would be inexpensive to use and would be capable of being used without a great deal of inconvenience or alteration to the well itself and yet would be efficient to achieve these objects.

What is required is a way of efficiently and expeditiously improving the hydraulic performance of the oil bearing strata of underground formations. Preferably such a method would be efficient, easy to use, and reliable. The instant invention provides for a method of selectively removing wax damage of any oil bearing strata through the use of solvents which are injected and heated downhole to dissolve plugging wax in the near well bore area. The invention also provides for a way of selectively plugging off and even irreversibly damaging any thief zones or strata which otherwise divert flood or injection water away from the oil bearing strata and which therefore reduce the effectiveness of the water flood injection. The instant invention also comprehends selectively and reversibly damaging the permeability of the oil bearing strata or target zones of the underground formation with a view to protecting the same by such damage from any subsequent irreversible damage which is directed to thief zones or strata. The present invention further comprehends selectively reversing the damage to the oil bearing target zones to remove any damage thereto. In this manner the effectiveness of the injection well can be enhanced by restricting the hydraulic permeability of these so called thief zones or strata while simultaneously improving the hydraulic permeability of the oil bearing target strata. Reversible damage may be achieved through use of a blocking fluid having sufficient waxy solids. Irreversible damage may be achieved through use of a different blocking fluid having a mix of particles of sizes appropriate to plug off the pore throats of the thief zones.

BRIEF DESCRIPTION OF THE DRAWINGS

Reference will hereinafter be made by way of example only to the attached figures which illustrate a preferred embodiment of the present invention and in which.

DETAILED DESCRIPTION OF THE DRAWINGS

Up until the present, the composition and solubility of wax has not been well understood. Typically, wax has been treated as a single compound and its solubility has been assumed to be a weak function of temperature. However, the normal paraffins (N-paraffins) which precipitate to form wax deposits in underground hydrocarbon reservoirs include species from $C_{20}H_{42}$ to $C_{90}H_{182}$ and higher. As mentioned earlier, the wax deposits are associated with the oil or condensate in the reservoir and typically contain between 30 and 90 percent of the associated liquid hydrocarbon. When a wax deposit precipitates from an oil or condensate, the composition of a particular wax deposit appears to depend both on the amount of each of the N-paraffins dissolved in the liquid hydrocarbon and the solubility of each of the N-paraffins in such liquid hydrocarbon. The solubility of a particular N-paraffin in a particular crude or condensate is related to the carbon number of the paraffin and the temperature and the solubility parameter of the liquid hydrocarbon. Thus, as the oil temperature changes, the composition of the wax deposits changes.

Figure 1:
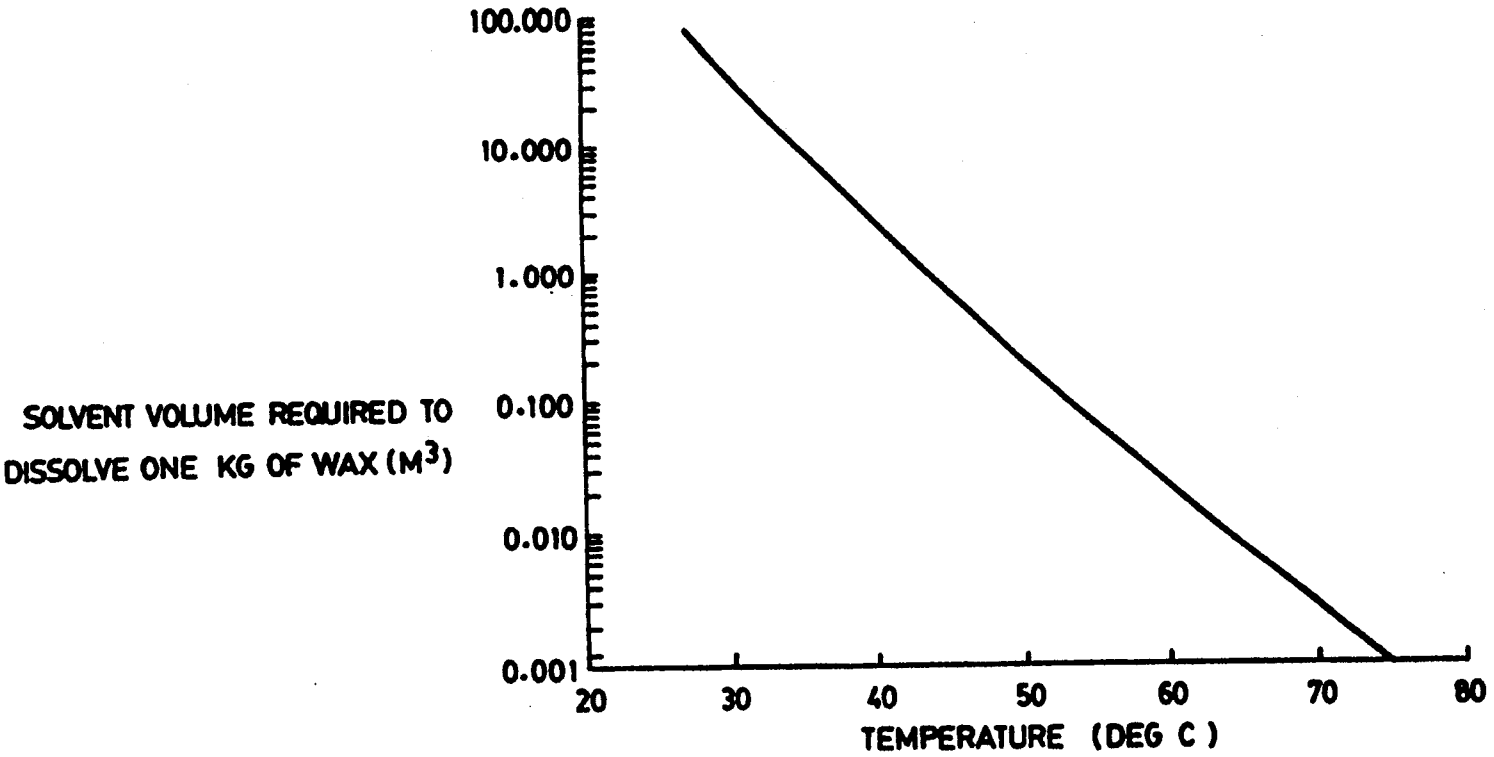
FIG. 1 is a graph depicting the relationship between solvent volume requirement to dissolve a downhole wax deposit (in $m^3$ solvent/kg of wax) against treatment temperature in degrees Celsius.

One of the techniques which has been used by industry to treat wells to remove wax deposits is to employ solvents; a solvent is pumped or "squeezed" into the formation to dissolve the wax. Although this technique has been frequently used, the composition of the wax deposit has generally not been known, and so the solubility of the reservoir wax in the solvent is not known either. FIG. 1 shows a solubility curve of the volume of a typical solvent required to dissolve 1 kilogram of a typical wax deposit as a function of temperature. For a reservoir temperature of 40° C., more than 2 $m^3$ of solvent are required to dissolve just 1 kilogram of wax. In general, excessive volumes of solvent are required to remove wax damage at reservoir temperature.

However, FIG. 1 also shows that if the solvent can be heated to 70° C., then only two liters of solvent are required per kg of wax deposit. Although different solvents are slightly more or less effective, the effect of temperature (i.e. the slope of the curve in FIG. 1) is similar for many different solvents. Thus, one surprising result is that the application temperature of the solvent is so critical in determining the effectiveness and usefulness of any such solvent treatment. However, what remains is how to effectively heat the solvent to achieve the desired effective and useful result, namely, the mobilization and removal of a significant amount of the accumulated wax deposits. In this context it will be appreciated that significant means sufficient removal of wax to measurably increase injection rates or flow rates through the treated area. In this context, to heat the solvent, means that the solvent has had its temperature raised above the naturally occurring temperature of the reservoir.

According to the present invention there is disclosed an apparatus and a method in which a solvent is heated directly adjacent to the treatment area. Several different sources of energy could be used to raise the temperature of the solvent at the bottom of the well (e.g., exothermic chemical reaction, electrical heating, radioactive decay). However, electrical heating is preferable due to safety, control, reliability and cost considerations. The use of electrical energy avoids certain problems inherent in the heating the solvent via chemical reaction. Firstly, it avoids the transportation of hazardous chemicals, such as oxidizers and fuels. Secondly, it avoids the difficulties associated with initiating ignition and controlling the chemical reaction, such as the rate of the chemical reaction and the hazards associated with any incomplete reactions, such as residual explosive mixtures of gas or corrosion. Electrical heating also avoids formation damage due to the oxidation of any aqueous species present. An example of this problem would be the oxidation of $Fe^{++}$ to $Fe^{+++}$ and a subsequent precipitation of $Fe(OH)_3$. Lastly, any partial oxidation of hydrocarbons in a chemical reaction heating system can produce gums, tars or asphaltene-like material which could plug the pores of the formation and create even worse formation damage than the solidified wax.

The generation of heat by dissipation of electrical power can occur by several means. For example, inductive, resistive, dielectric and microwave technologies can be used to generate heat from electrical power. Of these, a resistive heater described herein is preferred due to its compact size, simplicity, reliability and ease of control.

Figure 2:
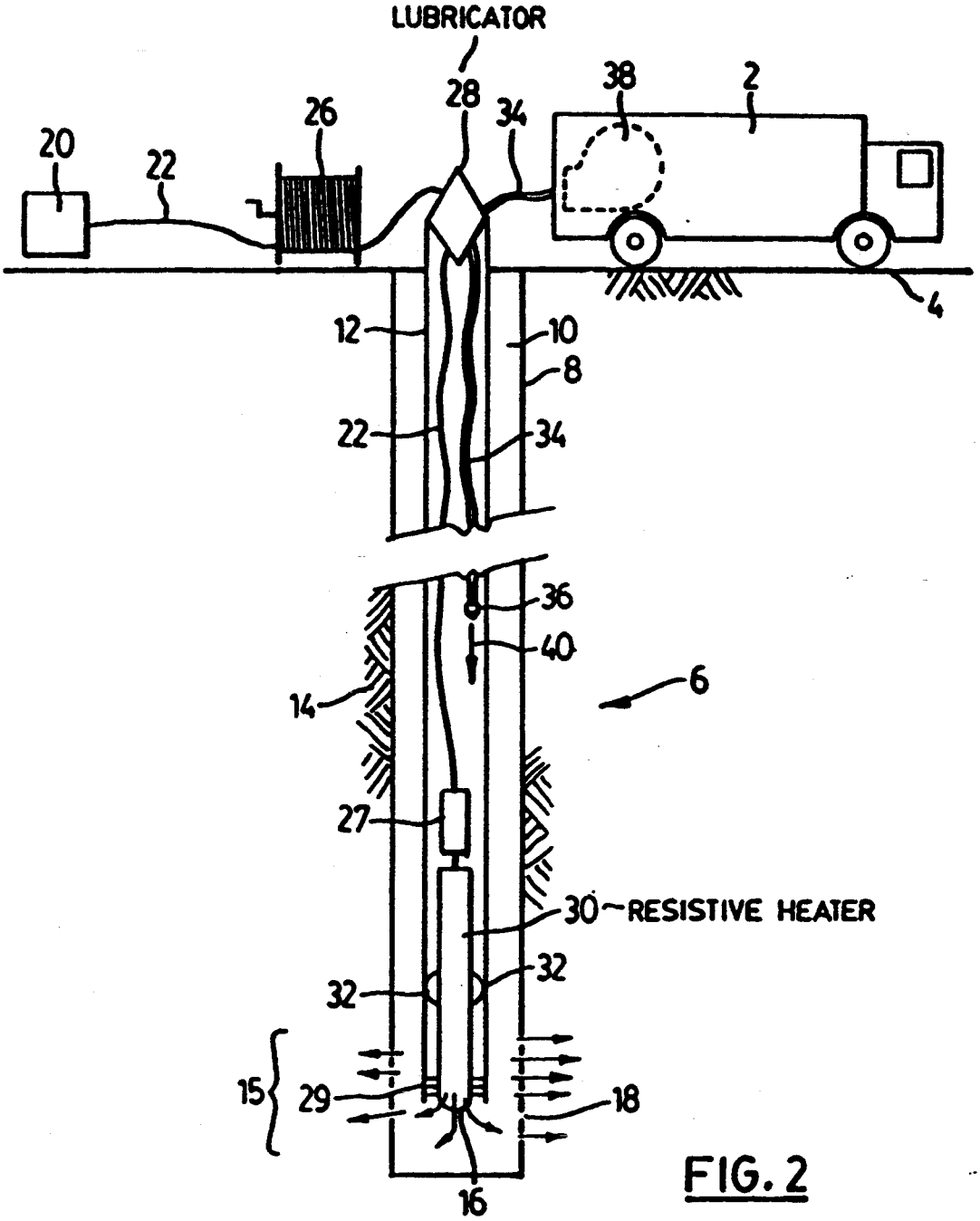
FIG. 2 is a preferred embodiment of the invention.

FIG. 2 shows a schematic diagram of a preferred embodiment of the invention. The equipment shown consists of a number of components. A truck 2 is shown resting on a surface grade 4. An oil well is shown schematically and oversized generally as 6 with an outer casing 8 forming an annulus 10 around a tubing string 12. The tubing string 12 penetrates through a formation 14 to a recovery zone 15.

At the bottom of the tubing string 12 is an opening 16 which allows fluid communication between the tubing string 12 and the annulus 10. Numerous perforations 18 are provided in the outer casing 8 at the recovery zone 15. The perforations 18 allow fluid communication between the annulus 10 and the recovery zone of the formation 15.

Also shown above grade are an electrical generator indicated schematically at box 20 which has power outlet cord comprising electrical conductor 22. The generator 20 is preferably of a portable diesel electric type, although in situations where the well 6 has an adequate supply of electrical power, the generator 20 may be replaced by a conventional electrical power grid hook-up, along with appropriate transformers, rectifiers and controllers. Dependent on the application, it may be advantageous to convert the alternating current (AC) power to direct current (DC) as more power can be carried by a given conductor 22 in DC operation and inductive coupling between the conductor 22 and the tubing 12 is also avoided.

The next component is a conductor assembly, which includes a winch 26 which raises and lowers the conductor 22 within the tubing 12. The winch 26 is operated by a gas or electric motor or the like. The insulated conductor 22 passes around the winch 26 and through a lubricator 28. The lubricator 28 facilitates the passage of the insulated conductor 22 into and out of the wellhead of the tubing 12. The lubricator 28 is also adapted to provide a pressure seal around the cables as required. The winch 26, lubricator 28 and electrical generator 20 will be familiar to those skilled in the art. Consequently they are not described in any further detail herein.

The electrical conductors 22 are preferably in the form of insulated electrical cables. Where the depth of the well is such that the strength of insulated cable is inadequate, such cables could be replaced or strapped onto the sucker rods (not shown) which are usually used in the well to raise and lower the pump. If the sucker rods were used as a conductor, they would have to be electrically isolated to prevent contact with the production tubing. The electrical power would then be transmitted downhole through the sucker rods. A further alternative would be to use the tubing 12 itself as a part of the electrical circuit as described in more detail below. However, this alternative would also require appropriate electrical isolation.

At the bottom end of conductor 22 is shown a set of jars 27 and a resistive heater 30. The jars 27 are slidably connected to the conductor 22 and can be used to supply a sudden impulse (jerk) to the heater 30 and thus free the same in the event it becomes stuck downhole. A contactor 32 is also shown which is utilized when the tubing 12 is used as a conductor to return the current back to the wellhead and to the generator 20 thereby completing the electrical circuit. Thus, the contactor 32 may be required to provide a good electrical contact between the tubing 12 and the heater 30. Alternatively, the conductor 22 could allow the current to return to the generator 20 via a return insulated electrical power line.

Figure 3:
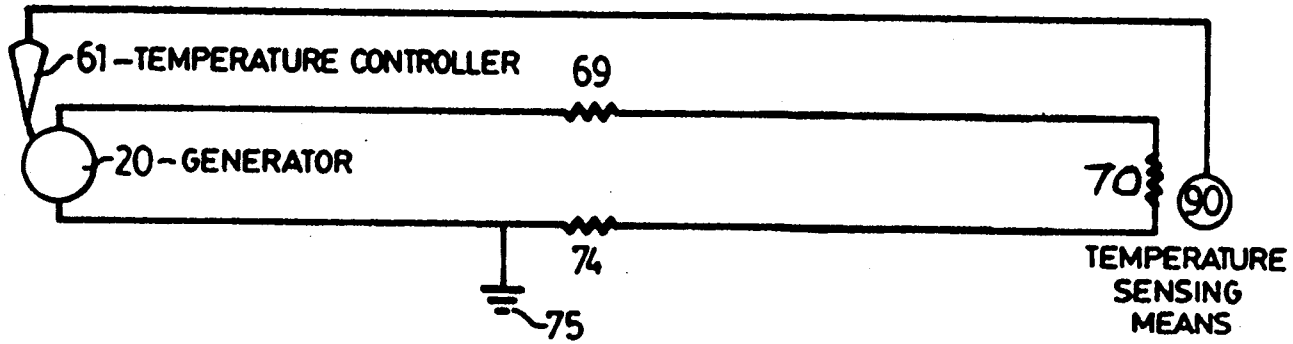
FIG. 3 is a circuit diagram of the preferred power circuit.

It will now be appreciated how the preferred electrical circuit of the present invention is configured. The electrical power is supplied by a variable voltage direct current (DC) power supply. DC power has several advantages over alternating current (AC), as mentioned before. The electric power is supplied by a direct current variable voltage portable diesel electric power generator. The voltage is controlled either manually or automatically on the basis of a temperature measurement in the heater, and the maximum current is limited to avoid overheating conductor(s) 22. FIG. 3 shows the electrical circuit schematically, including the resistance 69 of conductor 22 on the downward limb of the circuit and resistance 70 caused by the packed bed heater. The resistance 74 of the return limb of the conductor 22 is also shown. A connection to ground is shown as 75. The temperature controller 61 is also shown connected between the generator 20 and a temperature sensing means such as a thermocouple or the like, shown as 90. It will be appreciated by those skilled in the art that the temperature sensor 90 can communicate with the temperature controller via several different means including signal wires bundled with conductor 22.

It will also be appreciated by those skilled in the art that, in certain instances there may be no tubing 12 within the casing 8. In such circumstances, the casing itself may be used as a return conductor in the same manner as described above for the tubing. In this case a packer could be used to provide a hydraulic seal between the casing and the heater to force the solvent through the heater 30 and into the recovery zone 15 of the reservoir.

Thus, for a given power or heat transfer rate, higher solvent flowrates will result in lower heater outlet temperatures. Alternatively, a high heater outlet temperature can be obtained at a lower power by reducing the solvent flowrate. FIG. 1 shows that the required solvent volume decreases by three orders of magnitude for a 30° C. temperature rise. Thus a small temperature rise can provide a substantial benefit in terms of reducing solvent volume requirement. However, as the hot solvent is displaced into the pores in the reservoir formation or rock matrix, the hot solvent will cool down and the rock and immobile interstitial fluids will be heated. A large fraction of the cost (up to 50%) of the stimulation described herein is due to the cost of the solvent injected downhole. Thus, it is desirable to heat the solvent to the maximum feasible temperature which avoids solvent degradation and deleterious effects in the reservoir, such as mineral transformations. In this manner a maximum amount of heat or thermal energy is carried by a minimum volume of solvent.

It may now be appreciated how the method of the present invention may be employed. Prior to employing the preferred method the well is "killed" with a fluid to prevent uncontrolled backflow while the well 6 is open to the atmosphere. The next step in the preferred method is for the electrical cable 22 with the jars 27, resistive heater 30, and contactor assembly 32, to be lowered to the appropriate depth within the tubing 12 through the lubricator 28. The solvent truck 2 then begins to pump solvent into the well 6 at the desired rate by means of a pump 38. As shown in FIG. 2, a hose 34 passes through the lubricator 28 down into the tubing 12 and has a nozzle 36. It will be appreciated by those skilled in the art that the nozzle 36 may be placed at any desired location within the tubing 12 and in fact, it may be sufficient merely to connect the nozzle 36 to an appropriate orifice on the wellhead and simply pump the solvent directly down through the tubing 12. Alternatively it may be desirable to connect the hose 34 directly to the heater (e.g., if the tubing is completely blocked with wax) in order to pump solvent directly to the heater. The solvent then makes its way down the tube as indicated by arrow 40 where it encounters the resistive heater 30. The generator 20 is started and electrical power is then transmitted through electrical cable 22 and through the tubing 12 to the heater 30. As the solvent is pumped down the tubing 12, with the valve on the annulus 10 closed, it passes through the heater 30, out the bottom orifice 16 of the tubing 12, through the perforations 18, in the casing 8 and into the recovery zone of the formation 15. In some cases it may be necessary to seal the annulus 10 to prevent the solvent from circulating up. In addition it may be desirable to use a packer, gelled hydrocarbons or non condensible gas to reduce heat losses due to convection in the annulus.

When sufficient solvent has been displaced into the formation, the power to the heater is switched off. The conductor 22 and the heater 30 and hose 34, may then be removed from the well and the well may be put back onto injection. Alternatively, the hot solvent may be left to soak for a period of time before the well is put back into injection. Alternatively, a mutual solvent is pumped into the tubing to further displace solvent/wax away from the recovery zone surrounding the wellbore.

A mutual solvent is a liquid which is partially soluble in both oil and water. Such a liquid is EGMBE (ethylene glycol monobutyl ether) or isopropanol/toluene. Such a mutual solvent would have several beneficial effects, as will be now appreciated. For example, the mutual solvent will increase the mobility of a subsequent water injection by increasing the degree of saturation of the water phase relative to the oil phase. This mutual solvent will assist in flushing the wax solvent from the near wellbore area and thereby completing the cleanup of the near wellbore area.

In this context solvent refers to any fluid which has an external phase miscible in all proportions with wax at the melting point of the wax. Preferred solvents include crude oil and condensate, refinery distillate and reformate cuts (naphthenic, paraffinic, or aromatic hydrocarbons), toluene, xylene, diesel, gasoline, naptha, mineral oils, chlorinated hydrocarbons, carbon disulphide and the like. Miscibility is desirable to avoid relative permeability problems as described above. In the case where the solvent could be considered as an emulsion (e.g., a crude oil containing a small proportion of produced water), then the continuous phase of the solvent is miscible with the melted wax at the treatment temperature and pressure.

The flow rate of the solvent is determined by the pump capacity and pressure drop across the heater, as well as the desired solvent temperature rise for the available power supply. The depth of heat penetration into the formation will depend upon the total volume of solvent injected and the solvent temperature. The optimum distance that the heated solvent is injected into the reservoir will depend on the amount and depth of wax damage, as well as the porosity of the rock and will vary from well to well.

The volume of solvent used according to the present invention will also vary, depending upon the formation being treated. For example, if the wax deposits or formation damage are present at a large distance away from the wellbore, then a larger volume of hot solvent will be necessary. The treatment typically will require 1–30 $m^3$ of solvent per meter of formation being treated. The removal of wax accumulations from the formation will enhance the injectivity of the well. Such wax removal will also enhance other types of well treatment activities, including an acid stimulation and the like. It will also be appreciated by those skilled in the art that additives could be included in the solvent to enhance various properties. For example, these additives can include a number of chemicals, such as surfactants, dispersants, viscosity control additives, natural solvents, crystal modifiers, inhibitors and the like.

As can be appreciated from FIG. 1, increasing the temperature of the solvent 30° C. increases the wax carrying capacity of the solvent by 1000 fold. This temperature rise in turn increases the effectiveness of the well treatment and reduces the volume of liquid required. If less liquid is required, then less time is required to displace the solvent carrying the dissolved wax out of the near well bore area and the wax is less likely to cool down and reprecipitate in the near wellbore area so the injectivity will be increased. By using a miscible heated and effective solvent, the removal of wax from pores and micropores at the reservoir or production level can be accomplished. In the reservoir, an additional benefit of the hot solvent is due to minimizing the gas and water saturations and thus maintaining the highest feasible mobility or relative permeability for the oil/solvent/wax phase.

The solvent is pumped or flows through the resistive heating apparatus and is heated. For convenience and improved reliability, there may be temperature, pressure and flow monitoring instrumentation and control devices also included in the heater. It will be appreciated that while a preferred form of the heater has been previously described other heaters may also be used provided that they provide a sufficient level of heat to the solvent to allow an adequate heating of the wax to be heated.

Figure 4:
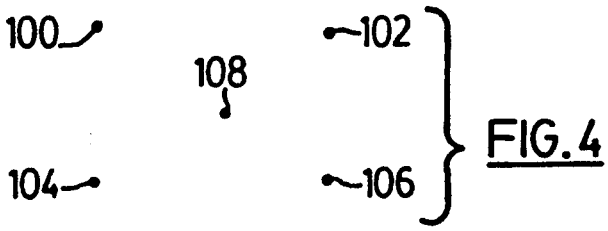
FIG. 4 is a plan view of a common injection/production well configuration.

Turning now to FIG. 4 there is shown a portion of a production field in which there are five wells and in which wells 100, 102, 104, and 106 are producing wells (i.e., hydrocarbons are recovered from these wells) and 108 is an injection well (i.e., water is injected into this well to maintain reservoir pressure and help displace oil towards the production wells). This particular configuration is known as a five spot pattern. It will be appreciated that the present invention applies to other patterns however, this pattern has been chosen by way of example.

As previously described, when the water is reinjected there is typically a small fraction of oil which in the water which is reinjected along with the water. The oil fraction typically contains waxy solids at the reinjection temperature and pressure. It can now be understood how the selective plugging due to wax carryover in the produced, then re-injected, waterflood water can be used to gain an advantage.

Figure 5:
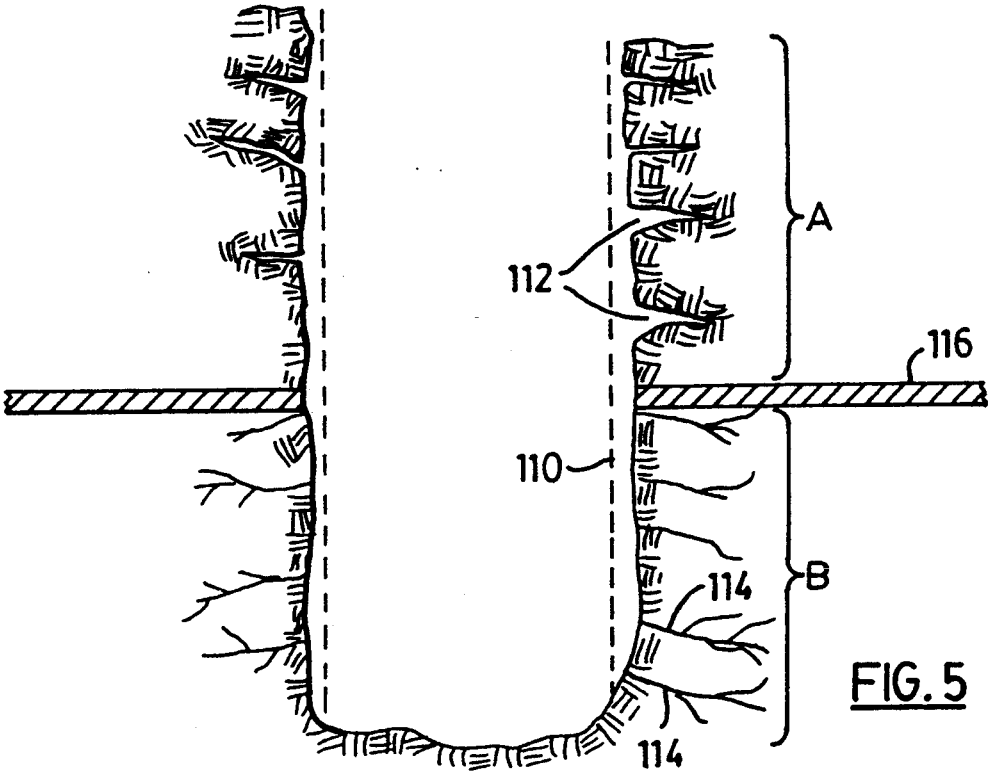
FIG. 5 is a schematic illustration of a near well bore region having zones of higher and lower permeability.

As shown in FIG. 5 the underground formation is 20 formed with different zones, each having a different permeability, which is a function of the natural geological characteristics of the reservoir. A perforated well casing is shown as 110, a high permeability zone as 112 and a low permeability zone as 114. There may be, for example, an impermeable rock layer 116 which provides a barrier between the high 112 and low 114 permeability zones. The high permeability zone 112 contains larger pores which facilitate the passage of fluid through this zone. The low permeability zone 114 contains small diameter pores which restrict the 30 passage of fluid through this zone. In this example, the high permeability zone 112 readily conducts the injection water from the injection well to the production well and thus acts as a thief zone. Even though most of the oil is contained within the low permeability target zone 114, it may not be possible to economically recover oil from the low permeability target oil zone due to the cost of handling the excessive water production passing through the thief zones and bypassing the target zone.

It will be understood that the zones as illustrated in FIG. 5 are by way of example only and that the high permeability or thief zone need not be necessarily oriented in the manner shown. In heterogeneous formations there may in fact be several thief and target oil zones. In general the higher permeability thief zones 112 will tend to have larger pores.

It can now be appreciated that in heterogeneous reservoirs eventually, due to channelling through the thief zone and gradual waxy build up in the near wellbore area of the target zones (due to reinjection of oil) that most of the injection water will bypass the target zones containing unrecovered oil. The method that may be applied to such an injection well is to lower the heater into the well adjacent to the sweep zone, and then energize the heater and inject heated solvent into the formation in the manner previously described, to remove wax damage from the plugged off target zone. The injection well can then be put back onto production and the waterflood water injected into the well again.

However, in some circumstances this method might not be successful due to the remaining high permeability of the thief zones. Improving the injectivity of the sweep zone may not have a sufficient impact on the proportion of water flowing through the different zones to allow economic recover of the oil from the target zone. Therefore, it is a further aspect of the present invention to take advantage of the selective plugging of the target zone by means of a pretreatment step.

More specifically, the present method can include a pretreatment step of injecting a fluid containing a plugging material, of which there are numerous formulations and products available, into the injection well to selectively plug off the thief zones, prior to any hot solvent treatment step. The plugging fluid is referred to hereafter as a thief zone blocker fluid or thief blocker, and an example of such a fluid is water containing suspended clay or polymer particles. The size of the particles would be selected so that the particles would be smaller than the pores in the thief zone so that particles could initially penetrate a short distance (i.e. several inches) into the thief zone before bridging off at the pore throats and thereby plugging of the thief zone. Because the low permeability target zones are already damaged with wax, these zones have limited inflow and consequently do not experience additional damage from injection of the thief zone blocker. However, once the thief zones have been blocked off by the damaging fluid, it is possible to remove the wax damage from the target sweep zones by the application of the heated solvent described herein. The net effect is to selectively shut off injection to the thief zones and selectively stimulate injection into the target sweep zones.

In this regard, it will be understood that a suitable damaging fluid is one in which the blocking particles are between $\frac{1}{3}$ and 1/7 of the mean size of the pores. At this size range, the particles will generally penetrate some depth (i.e. several inches) into the thief zone before bridging and consequently blocking off the high permeability pores. If the particles are larger than $\frac{1}{3}$ of the mean pore diameter, then they tend to form a filtercake on the surface of the formation. Such a filtercake then blocks the subsequent penetration of the particles into the formation. If the blocking particles are smaller than 1/7 of the pore diameter, then they are likely to pass through the pores with out having any lasting effect. Prior to formulating the composition of the thief blocker fluid it may be appropriate to study the core samples taken from the injection well for the purpose of choosing the appropriate blocking particle sizes.

It will be appreciated by those skilled in the art that to determine whether such a pretreatment step is warranted, it will be necessary to consider a number of factors including the injection history of the well, the nature of the waterflood injection water, the injectivity of the well and the records of adjacent production wells. In circumstances where it is unclear if the target sweep zones are in fact already plugged off with waxy solids, a further pretreatment step is appropriate as described in more detail below.

In a further aspect of the present invention it will be appropriate, in such circumstances prior to injecting a thief blocker fluid to block off or plug off the thief zones, to temporarily plug the less permeable target oil zones by a further pretreatment step of injecting an oil zone blocker fluid. Such a step would ensure that the target oil zones were protected from damage from the thief blocker fluid in the pretreatment step described above. An example of the oil zone blocker fluid is crude oil containing a significant concentration of waxy solids. In this sense significant means a high enough concentration over a long enough injection period to plug off the target oil zones. It will be appreciated that by appropriate selection of the type and concentration of wax species, selective plugging of the target zones can be accomplished.

Having plugged off and thus protected the target oil zones, any subsequent injection water will be diverted into the high permeability thief zones which are prone to premature waterflood breakthrough. Therefore, according to the present invention, the step of injecting an thief blocker fluid, into the injection well can then be performed to selectively plug off the high permeability thief zones. Because the target oil zones are already plugged off due to the wax solids in the oil zone blocker fluid, the target oil zones will have limited inflow and experience little or no damage from the thief blocker fluid. Then once the high permeability thief zones have been blocked off by this procedure, it is possible to remove the wax damage from the target oil zones by the application of heated solvent as described herein. The net effect is to selectively shut off water inflow into the high permeability thief zones and selectively stimulate injection into the target low permeability zones. In this manner, the injection profile into a layered reservoir could be modified to delay the waterflood breakthrough and improve the sweep efficiency of the waterflood. In the case where both a oil zone blocker fluid and a thief blocker fluid are used it will be appreciated that the average size of the particles in the oil zone blocker fluid will be smaller than the average size of the particles in the thief blocker fluid.

It will now be appreciated that unlike the thief blocker fluid, which causes permanent damage, the oil zone blocker fluid creates a reversible damage which selectively enhances the economical recovery of oil from a reservoir.

It will be further appreciated that this invention teaches the removal of wax deposits from oil gas and condensate reservoirs and injection systems by the use of a wax solvent which has been heated to greatly reduce the volume of solvent required to dissolve the solid wax. The preferred method contacts the wax with a heated solvent without raising the saturation of the water phase and thus avoid reducing the mobility of the oil/solvent/wax phase. The solvent is heated near the wax to be treated to avoid the premature loss of heat (or solvent temperature) as described for hot oiling. Moreover by appropriate choice of damaging fluids, it is possible to selectively plug and unplug target oil zones within an injection well, without requiring elaborate identification procedures or hydraulic isolation to assure that the treatments are performed on the appropriate zone.

It will be appreciated by those skilled in the art that the foregoing description is by way of example only and that many variations are possible within the broad scope of the claims. Some variations have been discussed above and others will be apparent to those skilled in the art.

I claim:

1. A method of stimulating an injection well, having a wellbore, said method comprising:

placing a heater within the wellbore, at or near the bottom of the wellbore, adjacent to the area to be treated; providing a source of power to said heater to energize said heater;

flowing a solvent past the said energized heater to heat said solvent;

flowing said heated solvent into the treatment area to contact solid wax deposits located in said treatment area to mobilize said wax and to form an oil/solvent/wax phase;

removing said solvent and said mobilized wax from said treatment area thereby removing solid wax deposits from said treatment area; and injecting waterflood water into the injection well.

2. A method of stimulating an injection well as claimed in claim 1 wherein said step of providing a source of power to said heater comprises providing electric power to said heater and wherein said step of placing a heater comprises placing an electric resistance heater in said wellbore.

3. A method of stimulating an injection well as claimed in claim 2 wherein said step of proving electric power further comprises passing said electrical power through a converter to convert AC current into DC current.

4. A method of stimulating an injection well as claimed in claim 3 wherein said step of providing said power includes using a portable electrical generator to generate said electrical power.

5. A method of stimulating an injection well as claimed in claim 4 wherein said step of placing said resistance heater in said well bore further comprises lowering said heater, and an associated electrical conductor down into said wellbore.

6. A method of stimulating an injection well as claimed in claim 5 wherein said heater and associated electrical conductor are removed from said wellbore prior to said step of injecting waterflood water.

7. A method of stimulating an injection well as claimed in claim 6 further comprising using portable stimulation equipment.

8. A method of stimulating an injection well as claimed in claim 1 wherein said step of providing electrical power to said heater to energize said heater further comprises measuring a bottomhole temperature and controlling the power to said heater in response to said measured temperature.

9. A method of stimulating an injection well as claimed in claim 1 wherein said step of flowing said solvent into the treatment area further comprises flowing between 1 and 30 cubic meters of solvent into said treatment area per meter of formation to be treated.

10. A method of stimulating an injection well as claimed in claim 1 wherein said solvent is crude oil.

11. A method of stimulating an injection well as claimed in claims 3 or 6, wherein said solvent includes one or more additives selected from the group of surfactants, dispersants, viscosity control additives, natural solvents, crystal modifiers and inhibitors.

12. A method of stimulating an injection well as claimed in claim 3 or 6 wherein said method further comprises using one or more of a packer, gelled hydrocarbons or a noncondesible gas to reduce heat losses due to convection in an annulus of said well.

13. A method of stimulating an injection well as claimed in claim 1 wherein said solvent is one or more from the group of toluene, xylene, diesel, gasoline, naphtha, mineral oil, chlorinated hydrocarbons and carbon disulphide.

14. A method of stimulating an injection well as claimed in claim 1 wherein said method further comprises a step of introducing a mutual solvent into said reservoir before said solvent is flowed past said heater and into the treatment area.

15. A method of stimulating an injection well as claimed in claim 14 wherein said mutual solvent is ethylene glycol monobutyl ether.

16. A method of stimulating an injection well as claimed in claim 1 including a pretreatment step of injecting a blocking fluid to damage said well to selectively enhance recovery from said well.

17. A method of stimulating an injection well as claimed in claim 16 wherein said blocking fluid reversibly damages said well.

18. A method of stimulating an injection well as claimed in claim 17 wherein said blocking fluid includes waxy solids to reversibly damage said well.

19. A method of stimulating an injection well as claimed in claim 16 wherein said blocking fluid selectively permanently damages portions of said well.

20. An injection well treating process to improve waterflood injection in said well, said process comprising:

a) selecting a solvent which is generally miscible with melted wax, b) pumping said solvent down the well at ambient temperature, c) heating said solvent below grade in the well at a position adjacent to the wax to be treated to minimize heat losses from said solvent during transportation of said solvent to the wax to be treated, d) contacting said heated solvent with the solid wax to be removed to mobilize said wax without reducing the relative permeability of the wax/solvent phase, e) removing said solvent and said mobilized wax from said fluid passageways, and injecting waterflood water into said fluid passageways which were previously restricted by said solid wax deposits.

21. An injection well treating method as claimed in claim 20 for treating an injection well having an underground formation with at least one low permeability target oil zone and having at least one high permeability thief zone wherein said at least one high permeability thief zone could contribute to waterflood breakthrough, said method including a pretreatment step of:

selecting an appropriate thief zone blocker means for reducing the injectivity of said at least one high permeability thief zone; and injecting said thief zone blocker means into the injection well to reduce the injectivity of said high permeability zones which would contribute to early waterflood breakthrough, to selectively restrict injectivity of said high permeability thief zones which would otherwise divert waterflood injection water away from the target oil zones.

22. An injection well treating method as claimed in claim 21, including a further pretreatment step of:

selecting an appropriate target oil zone blocker means for reversibly reducing the injectivity of said low permeability target oil zones; and injecting said oil zone blocker means into the injection well, prior to injecting said thief zone blocker means, thereby reducing the injectivity of said target oil zones to the thief zone blocker means, to protect said low permeability target oil zones from being damaged by said thief zone blocker means.

23. An injection well treating method as claimed in claim 22, wherein said thief blocker means contains thief zone blocking particles and said oil zone blocker means contains oil zone blocking particles and said thief zone blocking particles are on average larger than the oil zone blocking particles.

24. An injection well treating method as claimed in claim 23, wherein said oil zone blocking particles are waxy solids between $\frac{1}{3}$ and 1/7 of the average size of the pores in the target oil zone.

25. An injection well treating method as claimed in claim 23, wherein said thief zone blocking particles are between $\frac{1}{3}$ and 1/7 of the average size of the pores in the thief zone.

26. An injection well treating process to improve waterflood injection in said well as claimed in claim 20, wherein said step of selecting said solvent comprises using crude oil.

27. An injection well treating process to improve waterflood injection in said well as claimed in claim 26 wherein said electrical heater is a resistance heater.

28. An injection well treating process to improve waterflood injection in said well as claimed in claim 27 wherein said resistance heater is powered by DC current.

29. An injection well treating process to improve waterflood injection in said well as claimed in claim 20 wherein said step of selecting said solvent comprises selecting one or more from the group of toluene, xylene, diesel, gasoline, naphtha, mineral oil, chlorinated hydrocarbons and carbon disulphide.

30. An injection well treating process to improve waterflood injection in said well as claimed in claim 20 wherein said step of heating said solvent below grade comprises passing said solvent past an electrical heater.

31. An injection well treating process to improve waterflood injection in said well as claimed in claim 20 wherein said treatment includes lowering an electrical resistance heater into said well prior to injecting said solvent.

32. An injection well treating method for treating wells having an underground formation with less permeable target oil zones and more permeable zones, said method comprising:

selecting an appropriate cold crude oil containing a range of waxy solid particle sizes to selectively obstruct said less permeable zones, injecting said cold crude into an injection well, thereby reducing the injectivity of said less permeable zones, selecting an appropriate fluid containing blocking means, to reduce the injectivity of the high permeability zones, injecting said blocking means into the injection well, thereby reducing the injectivity of said high permeability zones, selecting a solvent which is generally miscible with melted wax, pumping said solvent into the well at ambient temperature, heating said solvent below grade in the well at a position adjacent to the wax to be treated to minimize heat losses from said solvent during transportation of said heated solvent to the wax to be treated, contacting said heated solvent with the solid wax to be removed to mobilize said wax without reducing the relative permeability of the wax/solvent phase, removing said solvent and said wax from said fluid passageways, and thereby modifying the injectivity profile of the injection well to improve the sweep efficiency of the target oil zones by selectively enhancing the injectivity of the zones which are less permeable and selectively restricting injectivity of the more permeable zones which would otherwise contribute to waterflood breakthrough.

* * * * *